US005081807A

United States Patent [19]

Murdza

[11] Patent Number: 5,081,807

[45] Date of Patent: Jan. 21, 1992

[54] LINTEL BLOCK CONSTRUCTION

[75] Inventor: Andrew Murdza, Pasadena, Md.

[73] Assignee: G/DEC International, Ltd., Upperco, Md.

[21] Appl. No.: 676,351

[22] Filed: Mar. 28, 1991

[51] Int. Cl.[5] ..... E06B 1/00

[52] U.S. Cl. ..... 52/204; 52/589; 52/591; 52/608; 52/609

[58] Field of Search ..... 52/566, 567, 563, 591, 52/594, 608, 609, 610, 611, 204

[56] References Cited

U.S. PATENT DOCUMENTS

| | | | |
|---|---|---|---|
| 144,149 | 10/1873 | Seldis | 52/608 |
| 1,463,759 | 7/1923 | Carson et al. | 52/609 |
| 4,197,669 | 4/1980 | Hynes | 52/608 |
| 4,429,506 | 2/1984 | Henderson | 52/589 |
| 5,024,035 | 6/1991 | Hanson et al. | 52/591 |

*Primary Examiner*—Richard E. Chilcot, Jr.
*Assistant Examiner*—Joanne C. Downs
*Attorney, Agent, or Firm*—H. Jay Spiegel

[57] ABSTRACT

Interlocking building blocks are disclosed which are designed to be used to form a lintel over a doorway, window or other opening in a building structure. The building blocks of the present invention are designed to interface with generally rectangular cubic building blocks which are used to form walls of a building. The inventive blocks include passageways therethrough allowing receipt of reinforcing rebar steel and interconnect to form a smooth consistent and effective structure.

7 Claims, 7 Drawing Sheets

LINTEL BLOCK CONSTRUCTION

BACKGROUND OF THE INVENTION

The present invention relates to an IMPROVED LINTEL BLOCK CONSTRUCTION. In the prior art, lintels are known and have been made of materials such as one piece of stone, a plurality of bricks, various structures mounted on a steel beam, etc. However, Applicant is unaware of any prior art which teaches the interlocking nature of a lintel block construction such as disclosed herein.

U.S. Pat. No. 2,184,714 to Freeman discloses a building construction including various elements which are reinforced through the use of wires or bars 5 placed within the pieces during molding or casting thereof. This is different from the teachings of the present invention wherein the inventive blocks are provided with passageways therethrough which allow placement of reinforcing bars therethrough in a manner allowing assembly at the construction site. Freeman shows, in FIG. 1 thereof, a lintel formed of a single elongated piece of masonry. Again, this is different from the teachings of the present invention.

U.S. Pat. No. 3,076,293 to Baudoux discloses a method of constructing a building including a lintel designated by the reference numeral L in FIG. 1 thereof and including a plurality of blocks mounted in adjacency. This is different from the teachings of the present invention which discloses an interlocking structure and reinforcement nowhere taught or suggested by Baudoux.

The present invention constitutes an improvement over earlier issued U.S. Pat. No. 4,429,506 to Henderson, the details of which are incorporated by reference herein. In Henderson, interlocking building blocks are disclosed which are designed to form the walls of a building as well as to form the lower portions of an opening such as a window opening. This aspect of the Henderson invention is best seen with reference to FIG. 3. However, Henderson fails to disclose any details of the provision of a lintel structure designed to interlock with the blocks disclosed therein and such aspect is absolutely necessary to facilitate completion of construction. It is with this thought in mind that the present invention was developed.

SUMMARY OF THE INVENTION

The present invention relates to an IMPROVED LINTEL BLOCK CONSTRUCTION. The present invention includes the following interrelated objects, aspects and features:

(a) In a first aspect, as stated above, the inventive interlocking blocks of the present invention are intended to interface with blocks such as those taught in U.S. Pat. No. 4,429,506 to Henderson. In particular, the blocks of the present invention are intended to be used to define the upper extent of a doorway or window opening and are so designed and constructed as to interlock in a manner allowing safe and secure support of wall structures above the inventive lintel block construction.

(b) The inventive lintel block construction includes the provision of five blocks. Three of these blocks have innersurfaces which combine together to define the upper extent of a doorway or window. The other two blocks mount above the above-mentioned three blocks to allow transition back to the generally rectangular cubic blocks such as those disclosed by Henderson to form the rest of the surrounding wall structure.

(c) Of the three blocks which together define the upper extent of the doorway or window opening, a central such block is elongated and preferably centrally located over the opening. The other two blocks are symmetrically located to either side of the centrally located block and form the upper corners of the window opening or doorway.

(d) The two blocks last mentioned above are preferably triangular in cross-section and sit atop the three first mentioned blocks to interface with the rectangular cubic blocks to be assembled in surrounding relation thereto.

As such, it is a first object of the present invention to provide an improved lintel block construction. It is a further object of the present invention to provide such a construction including five interlocking blocks combined together to not only define the top portion of a window opening or doorway but also to interface with other blocks forming a wall structure.

It is a still further object of the present invention to provide such blocks including passageways therethrough designed to receive, after manufacture, and during construction elongated reinforcing rebar steel structures.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
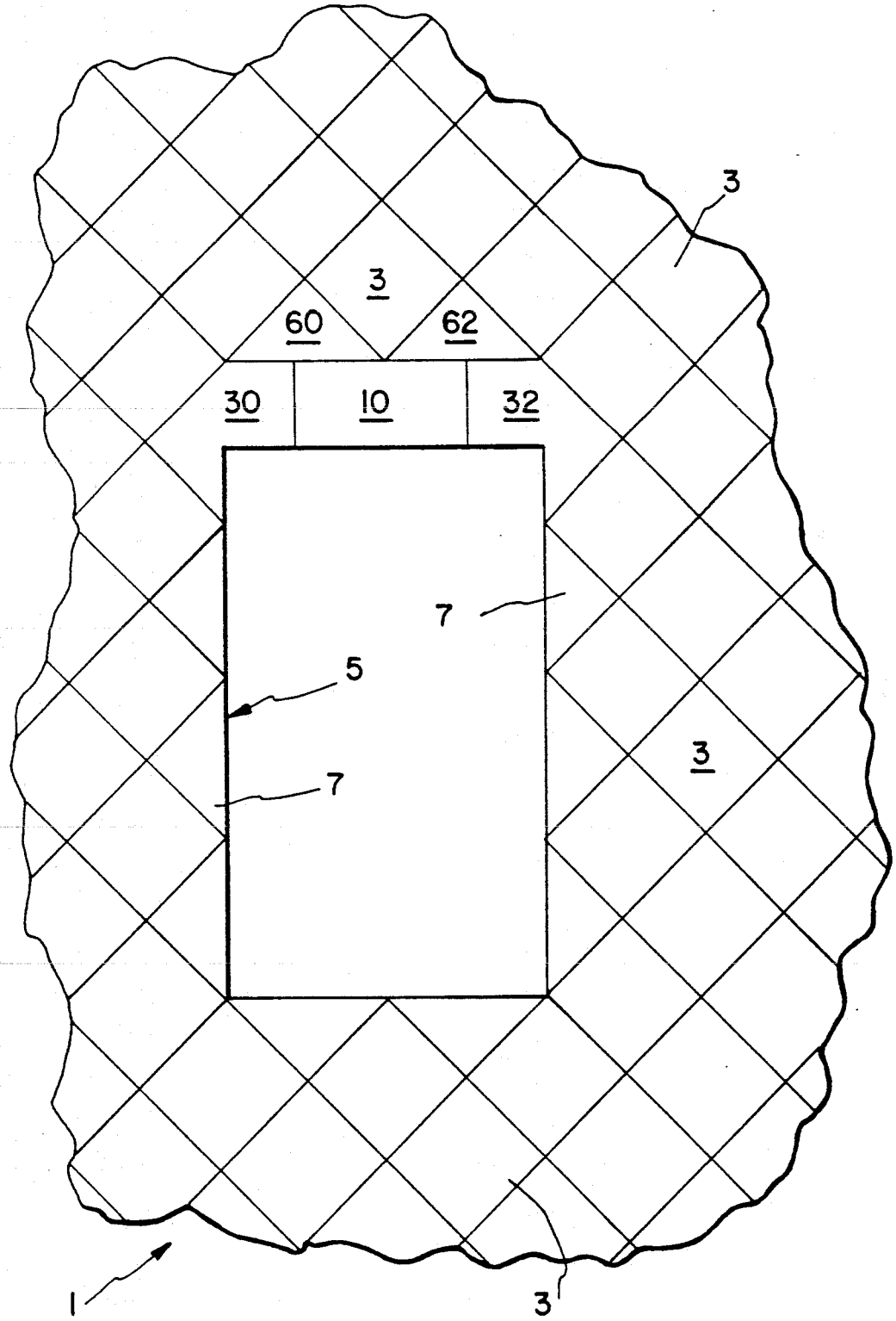
FIG. 1 shows a front view of a portion of a wall structure incorporating the present invention therein.

With reference, first, to FIG. 1, a wall construction is generally designated by the reference numeral 1 and is seen to include a plurality of generally rectangular cubic blocks designated by the reference numeral 3 and interlocked together in the manner disclosed in U.S. Pat. No. 4,429,506.

The wall 1 includes an opening 5 shown in FIG. 1 as being a window opening although, for the purposes of description of the present invention, the opening 5 could also be a doorway or other opening in a construction wall.

As shown, surrounding the bottom of the opening 5 and portions of the side walls thereof are a plurality of generally triangular cross-section blocks 7.

The present invention consists of the block 10, the corner blocks 30 and 32 and the generally triangular shaped blocks 60 and 62. These blocks 10, 30, 32, 60 and 62 combine to not only create the upper portion of a window or door opening but also combine to merge with the existing blocks 3 to form a cohesive strong wall construction.

Figure 2:
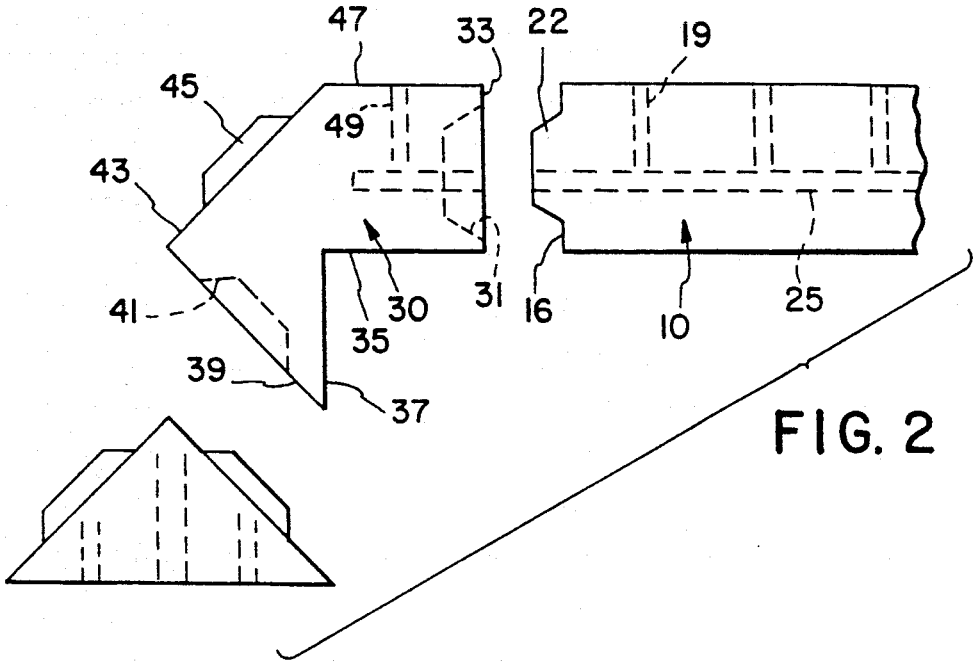
FIG. 2 shows a further front view of two of the blocks forming a part of the present invention with the blocks slightly separated and showing aspects in phantom to show detail.

With reference, now, to FIG. 2, the blocks 10 and 30 are shown. The block 10 will now be described with reference to FIGS. 2, 3 and 4.

Figure 3:
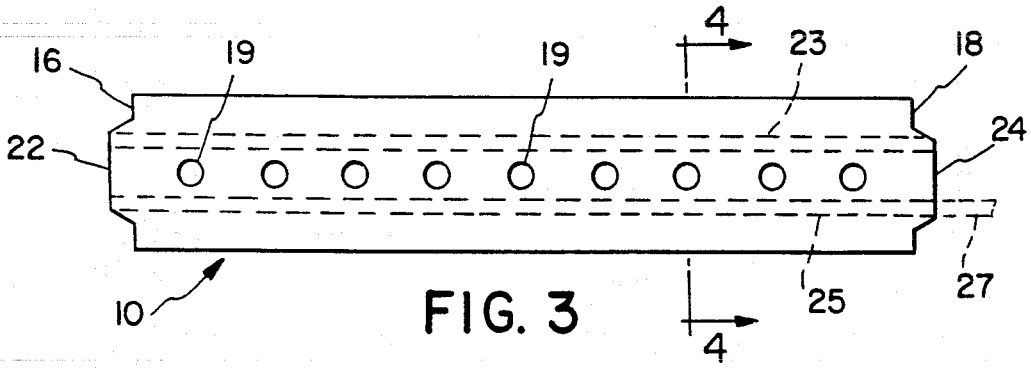
FIG. 3 shows a top view of one of the blocks illustrated in FIG. 2.
Figure 4:
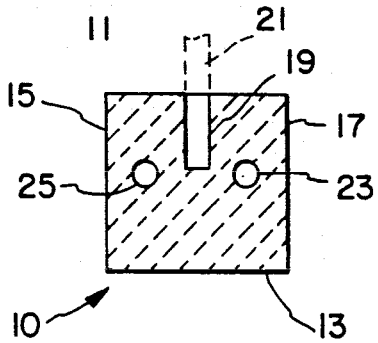
FIG. 4 shows a cross-sectional view along the line IV—IV of FIG. 3.
Figure 5:
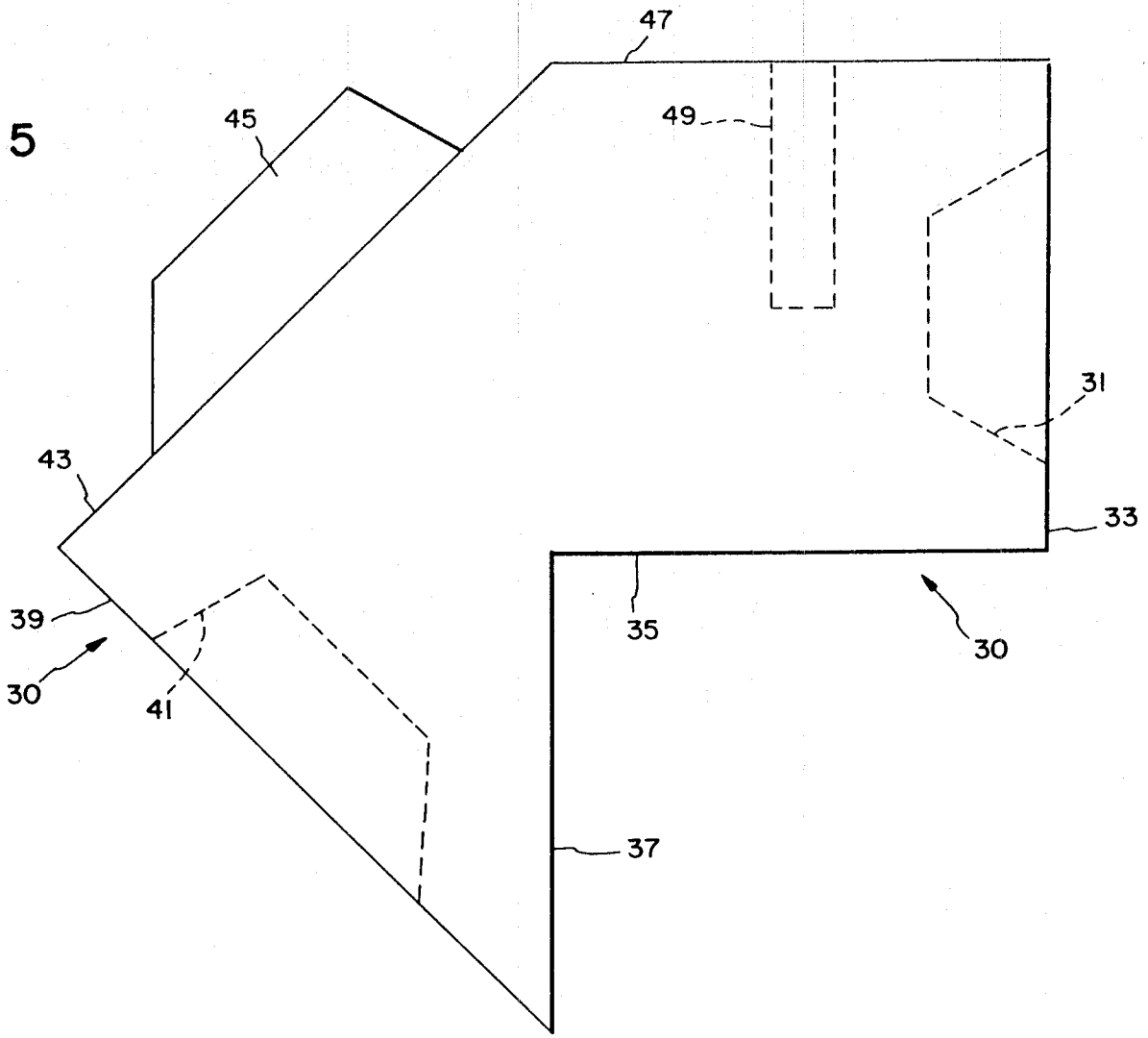
FIG. 5 shows an enlarged front view of the other block illustrated in FIG. 2.

The block 10 is seen to be of generally rectangular cross-section (FIG. 4) having a top surface 11, a bottom surface 13 and side walls 15 and 17. As shown in FIG. 3, in particular, the top wall 11 forms the entry point for a plurality of blind passageways 19 which extend about halfway through the block as best seen in FIG. 4. These passageways are designed to receive reinforcing steel bars such as the bar 21 shown in phantom in FIG. 4. These bars 21 may be provided in any suitable length as desired to allow interconnection with openings in other construction blocks used to form the construction wall.

As also seen in FIGS. 3 and 4, the block 10 has two parallel passageways 23 and 25 which are located to either side of the blind bores 19 and extend completely through the block 10. These bores are designed to receive steel reinforcing rods such as the rod 27 shown in phantom in FIG. 3. These rods 21, 27 are not formed in the block 10 while it is being manufactured but, rather, are inserted therein afterward.

As seen in FIGS. 2 and 3, the block 10 has end walls 16 and 18 each of which has a protrusion extending outwardly therefrom, with the protrusions being designated by the reference numerals 22 and 24 respectively. These protrusions are intended to be received within corresponding recesses in adjacent blocks such as the recess 31 in the block 30 as seen in FIG. 2.

With reference, now, to FIGS. 2 and 5–10, the details of the corner block 30 will be described in detail. It should be understood that the corner block 32 seen in FIG. 1 is generally symmetrical with the corner block 30.

As seen in FIG. 2, the block 30 includes a recess 31 in an end face 33 thereof, perpendicular faces 35 and 37, with the face 35 being perpendicular to the face 33, a face 39 having a recess 41 therein, with the face 39 defining, with the face 37 an angle of 45 degrees.

A further face 43 is provided at a right angle to the face 41 and has a protrusion 45 extending outwardly therefrom. The face 47 has a blind bore 49 extending therefrom which is designed to receive a reinforcing steel bar such as the bar 21 shown in FIG. 4. The corner block 30 has front and rear faces which are generally parallel to one another and are designated by the reference numerals 51, 53 as seen in FIGS. 6, 7, 8, 9 and 10.

Figure 7:
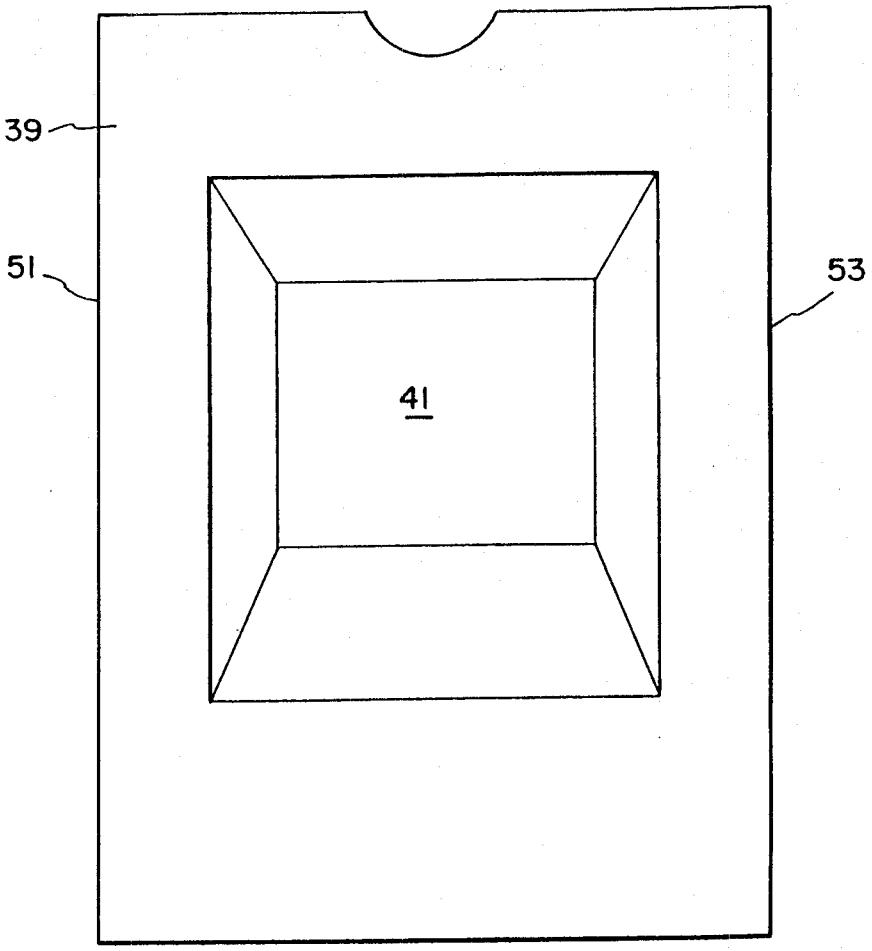
FIG. 7 shows a view looking diagonally upwardly and to the right as compared to the view of FIG. 5.
Figure 6:
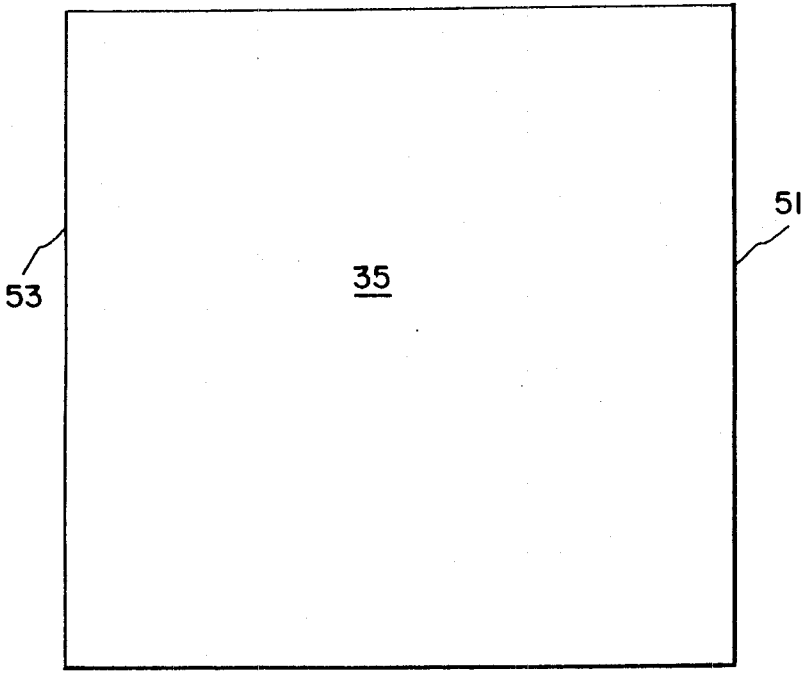
FIG. 6 shows a partial view looking upwardly at the block of FIG. 5.

FIG. 6 shows the face 35 while FIG. 7 shows the face 39 with its recess 41.

Figure 8:
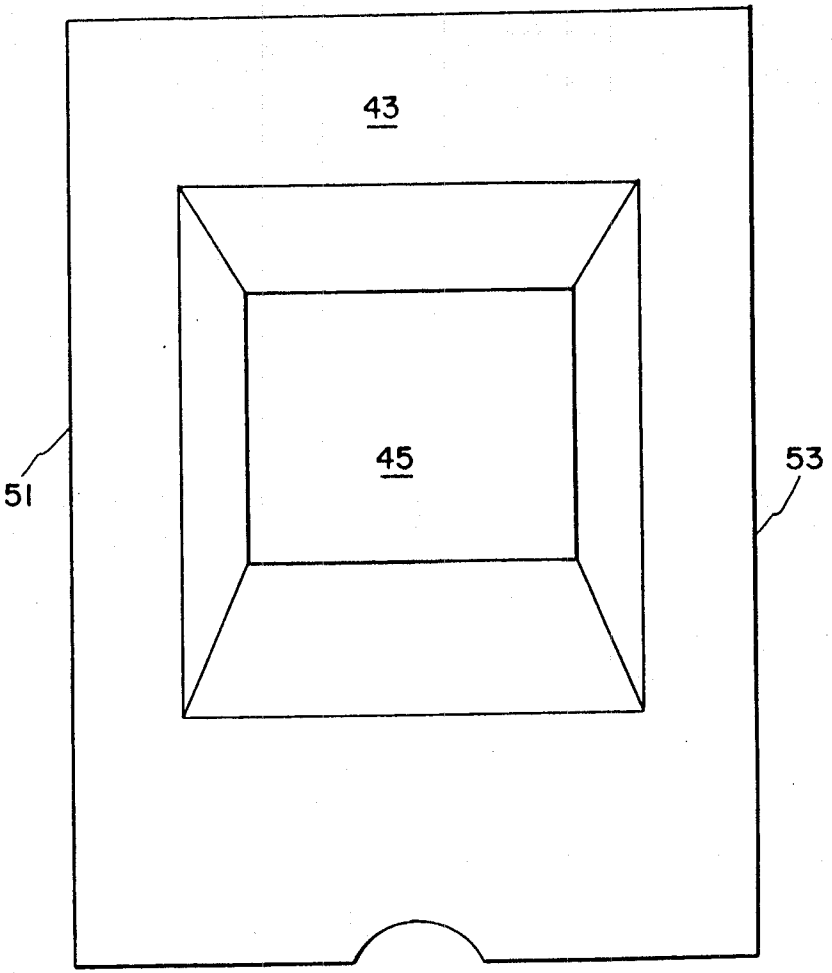
FIG. 8 shows a view looking diagonally downwardly and to the right as compared to the view of FIG. 5.
Figure 9:
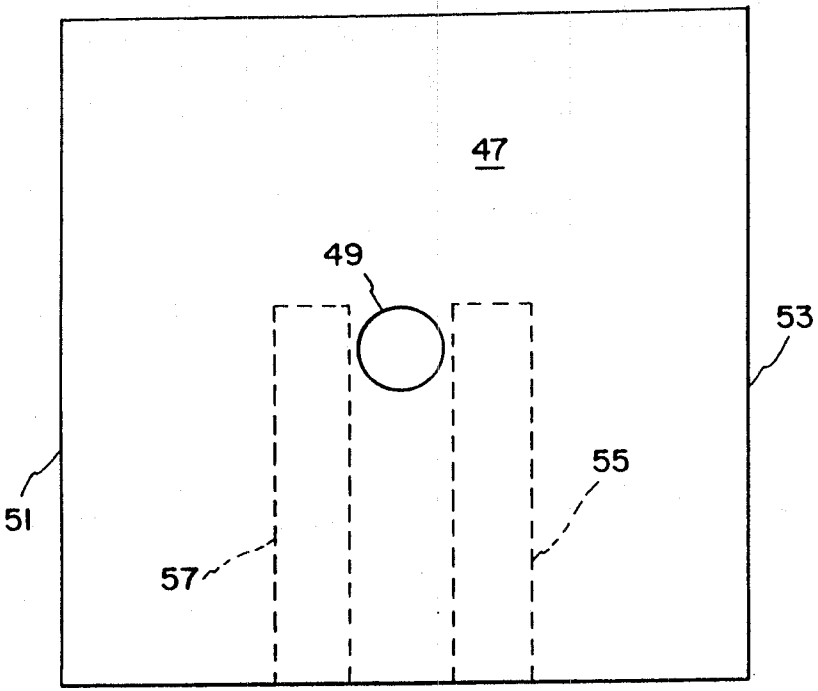
FIG. 9 shows a view looking downwardly into a portion of the structure shown in FIG. 5.
Figure 10:
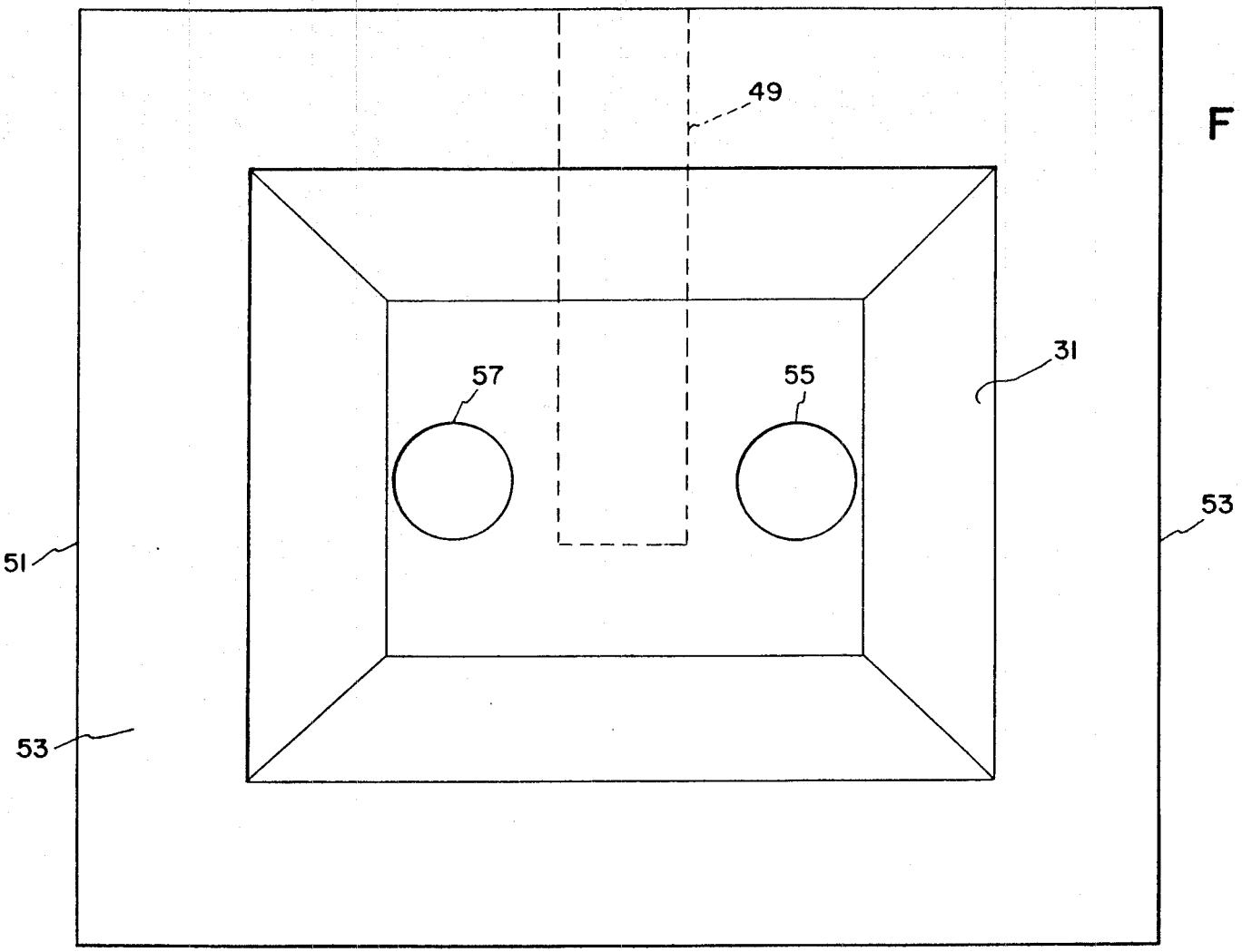
FIG. 10 shows a view looking toward the left hand direction as compared to the view of FIG. 5.

FIG. 8 shows the face 43 with the protrusion 45 while FIG. 9 shows the face 47 with the blind bore 49. FIG. 9 also shows, in phantom, two blind bores 55, 57 the entryways of which are seen in FIG. 10 at the bottom of the recess 31. These blind bores 55, 57 align with the bores 23, 25, respectively, when the blocks 10 and 30 are assembled together so that, for example, the elongated bar 27 which extends through the bore 25 may also enter the blind bore 57 to aid in assembling the blocks together and reinforcing them in assembly.

Figure 11:
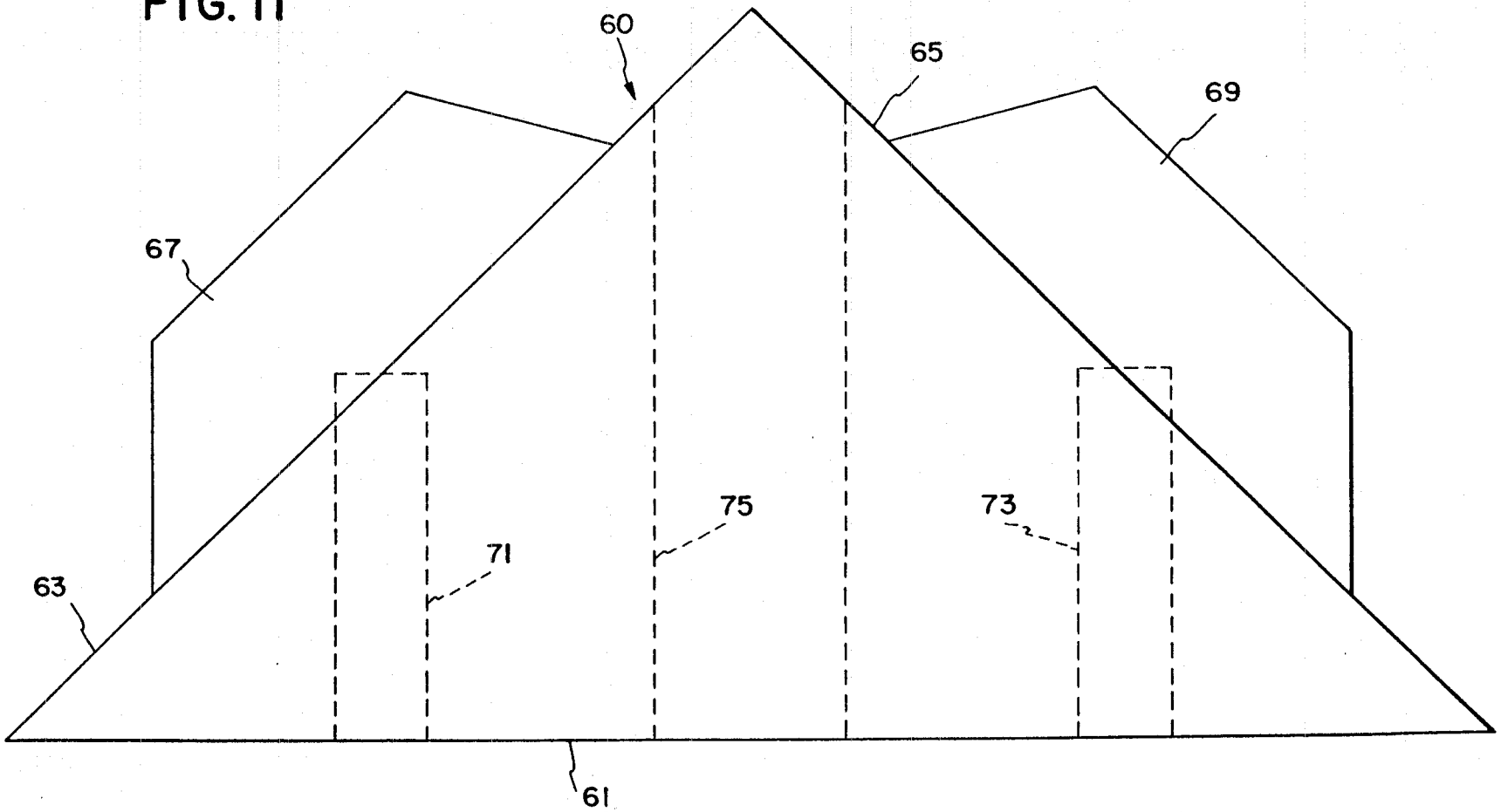
FIG. 11 shows a front view of a triangular-shaped block forming a part of the present invention with certain details shown in phantom.

FIG. 11 shows the block 60 as including faces 61, 63 and 65. The face 63 has a protrusion 67 while the face 65 has a protrusion 69. Blind bores 71, 73 opening from the face 61 align with the blind bore 49 in the block 30 and one of the blind bores 19 of the block 10 to allow firm attachment and stabilization of the block 60 on the blocks 10 and 30 without possibility of lateral movement. A central passageway 75 extending through the block 60 also may be used to receive a reinforcing steel bar (not shown) for reinforcement purposes.

The blocks 30 and 32 are similar in outward shape to the corner blocks particularly illustrated in FIGS. 13–16 of U.S. Pat. No. 4,429,506 to Henderson. However, several differences exist which are significant. Firstly, Henderson never contemplates the use of the blocks illustrated in FIGS. 13–16 and designated by the reference numerals 180 and 220 to provide the corners of a window opening or door frame. Thus, Henderson fails to contemplate the reinforcing bar structure disclosed in this patent application for use with such blocks. Furthermore, looking, for example, at the Henderson block 180, this block has a face 188 which is intended to be visible from outside the construction wall and thus has a flat face. The present invention, which contemplates the blocks 30 and 32 forming a part of a lintel construction, looking, for example, to the block 30, has a recess 31 in the corresponding face 33 designed to merge with a protrusion and having the further provision of means to receive reinforcing elongated steel rods.

Furthermore, looking, for example, to the inventive block 30, this block includes flat surfaces 35, 37 which combined together to form the corner of a window opening or doorway. In the Henderson blocks, one of these surfaces has either a protrusion or a recess which would interfere with the smooth lines which are intended for a window opening or doorway. Thus, the Henderson block 180 includes a recess 186 while the Henderson block 220 includes a protrusion 226. This is significantly different from the teachings of the present invention.

As seen in FIG. 1, the blocks 10, 30, 32, 60 and 62 not only combine together to form a lintel covering a doorway or window opening but are also specifically sized, configured and designed to merge into a wall construction 1 having existing blocks 3, 7 in a smooth and uninterrupted manner. In this way, the feasibility of using a block system such as that which is disclosed by Henderson for use to provide window openings and doorways is feasible.

As such, an invention has been disclosed in terms of a preferred embodiment thereof which fulfills each and every one of the objects of the invention as set forth hereinabove and provides a new and useful lintel block construction of great novelty and utility.

Of course, various changes, modifications and alternations in the teachings of the present invention may be contemplated by those skilled in the art without departing from the intended spirit and scope thereof. As such, it is intended that the present invention only be limited by the terms of the appended claims.

I claim:

1. In a wall construction consisting of a multiplicity of generally rectangular cubic blocks and triangular cross-section blocks assembly together to form a wall having an opening therethrough, the improvement comprising a lintel defining an upper portion of said opening, supporting portions of said wall above said lintel and merging into said wall, said lintel comprising:

a) a first block having a first surface defining a first upper corner of said opening and a second surface engaging at least one of said rectangular cubic blocks;

b) a second block having a first surface defining a second upper corner of said opening and a second surface engaging at least another of said rectangular cubic blocks;

c) a third block interconnected between said first and second blocks and having a first surface defining a top surface of said opening and a second surface generally parallel to said third block first surface and spaced therefrom; and d) a fourth block having a first surface engaging said third block and one of said first block and said second block, and, a second surface engaging at least a further rectangular cubic block.

2. The invention of claim 1, wherein said fourth block has a generally triangular cross-section.

3. The invention of claim 1, wherein said first, second, third and fourth blocks have passageways therethrough and blind bores, said passageways and blind bores being aligned when said blocks are assembled together, and further including reinforcing metal rods contained within said passageways and blind bores, each of said rods extending between at least two adjacent blocks to reinforce and strengthen said lintel.

4. The invention of claim 1, wherein said third block elongated rectangular cubic shape.

5. The invention of claim 1, wherein said blocks have engaging faces with interlocking structure.

6. The invention of claim 1, further including a fifth block generally corresponding to said fourth block.

7. The invention of claim 6, wherein said fifth block has a generally triangular cross-section.

* * * * *